US006938307B2

(12) United States Patent
Liu

(10) Patent No.: US 6,938,307 B2
(45) Date of Patent: Sep. 6, 2005

(54) SHOELACE FASTENER

(76) Inventor: Kun-Chung Liu, No. 5, Alley 9, Lane 212 San-Feng Rd., Hou-Li Hsiang, Taichung Hsien (TW)

( * ) Notice: Subject to any disclaimer, the term of this patent is extended or adjusted under 35 U.S.C. 154(b) by 22 days.

(21) Appl. No.: 10/761,229

(22) Filed: Jan. 22, 2004

(65) Prior Publication Data

US 2005/0160569 A1 Jul. 28, 2005

(51) Int. Cl.[7] ..... A43C 7/08
(52) U.S. Cl. ..... 24/712.5; 24/712.1
(58) Field of Search ..... 24/712, 713.4, 24/712.9, 712.5, 713.2, 712.1, 712.4, 115 G; 36/50.1, 51

(56) References Cited

U.S. PATENT DOCUMENTS 6,453,524 B1 * 9/2002 Liu ..... 24/712.5
6,453,525 B1 * 9/2002 Liu ..... 24/712.5
6,571,438 B2 6/2003 Liu
6,779,281 B1 * 8/2004 Liu ..... 24/712.5
6,782,588 B1 * 8/2004 Liu ..... 24/712.5
6,796,009 B1 * 9/2004 Liu ..... 24/712.6
6,817,070 B1 * 11/2004 Liu ..... 24/712.5
6,839,944 B1 * 1/2005 Liu ..... 24/712.1
2004/0250388 A1 * 12/2004 Martin ..... 24/712.5
2005/0015947 A1 * 1/2005 Liu ..... 24/712.5

* cited by examiner

*Primary Examiner*—Robert J. Sandy
(74) *Attorney, Agent, or Firm*—Foley & Lardner LLP

(57) ABSTRACT

A shoelace fastener for a shoe includes a clamp unit and a pull lace. The clamp unit includes at least one generally U-shaped flexible string section defining an opening, and at least one clamp member attached slidably to and extending across the flexible string section to divide the opening into a first aperture and a second aperture. The flexible string section has a U-bend cooperating with the clamp member to confine the second aperture. The clamp member is slidable along the flexible string section between a clamping position in which the clamp member moves toward the U-bend, and a releasing position in which the clamp member moves away from the U-bend. The pull lace is connected to the flexible string section for pulling the flexible string section so that the clamp member slides along the flexible string section to the releasing position.

14 Claims, 14 Drawing Sheets

SHOELACE FASTENER

BACKGROUND OF THE INVENTION

1. Field of the Invention

The invention relates to a shoelace fastener for a shoe, more particularly to a shoelace fastener for maintaining a tightened state of the shoe.

2. Description of the Related Art

U.S. Pat. No. 6,571,438 discloses a double-bow shoelace device that is adapted to be mounted on a shoe and that includes a shoelace, a clamp member, and an assembly of two loops and a decorative knot. The shoelace has a first lace segment that is strung on the shoe, and a second lace segment that includes first and second lace portions, each of which has a lower end connected to the first lace segment. The clamp member is sleeved slidably on at least one of the lace portions, and includes an elongate casing, a clamping block slidably received in the casing, and a biasing member disposed in the casing for biasing the clamping block to a lace clamping position. Downward and upward movements of the clamp member along at least one of the lace portions result in tightening and loosening of the shoe. The assembly is disposed on and externally of the clamp member.

Although the aforesaid shoelace device serves the purpose of tightening and loosening of the shoe, there are some drawbacks associated therewith. Particularly, because the clamping block of the clamp member must be forced inwardly into the casing against the biasing action of the biasing member when it is desired to loosen the shoe, the overall size of the clamp member must be large enough for the fingers of the user to press the clamping block and the clamp member toward each other. The relatively large clamp member has an adverse affect on the appearance of the shoe. It is also noted that the assembly of the loops and the knot on the clamp member is merely for decorative purpose, and does not have any practical function associated therewith.

FIG. 1 illustrates another conventional shoelace fastener 3 for a shoelace 4 having a pair of distal lace portions 402. The fastener 3 includes a plate body formed with an inner pair of lace entry holes 301 and an outer pair of lace exit holes 302. Two resilient clamp members 303 extend integrally from the plate body into the lace exit holes 302, respectively. In use, the distal lace portions 402 are first extended through the lace entry holes 301 and are subsequently extended through the lace exit holes 302. The clamp members 303 clamp the distal lace portions 402 against the plate body of the fastener 3. Although the aforesaid shoelace fastener 3 also serves the purpose of tightening and loosening of a shoe (not shown), there are still some drawbacks associated therewith. Particularly, since the fastener 3 must be pulled upwardly when it is desired to loosen the shoe, the lack of a pull component (not shown) on the fastener 3 makes it difficult to conduct the pulling operation. Moreover, the size of the fastener 3 must be relatively large in order to facilitate upward pulling of the same.

SUMMARY OF THE INVENTION

Therefore, the object of the present invention is to provide a shoelace fastener for a shoee that can overcome the aforesaid drawbacks associated with the prior art.

According to this invention, there is provided a shoelace fastener for a shoe that includes a shoe body with a pair of eyelet tabs, and a shoelace strung on the eyelet tabs and having a pair of distal lace segments. The shoelace fastener includes a clamp unit and a pull lace.

The clamp unit includes at least one generally U-shaped flexible string section defining an opening, and at least one clamp member attached slidably to and extending across the flexible string section to divide the opening into a first aperture and a second aperture. The flexible string section has a U-bend which cooperates with the clamp member to confine the second aperture. The clamp member is slidable along the flexible string section between a clamping position in which the clamp member moves toward the U-bend to clamp a corresponding one of the distal lace segments against the U-bend for maintaining a tightened state of the shoe, and a releasing position in which the clamp member moves away from the U-bend to permit sliding movement of the corresponding one of the distal lace segments for loosening the shoe accordingly.

The pull lace is connected to the flexible string section for pulling the flexible string section so that the clamp member slides along the flexible string section to the releasing position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
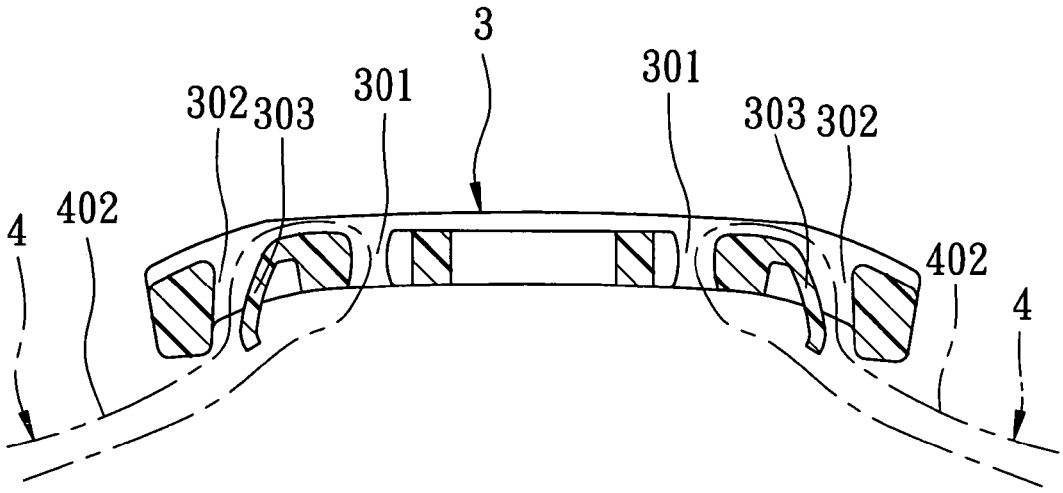
FIG. 1 PRIOR ART
FIG. 1 is a sectional view of a conventional shoelace fastener.
Figure 2:
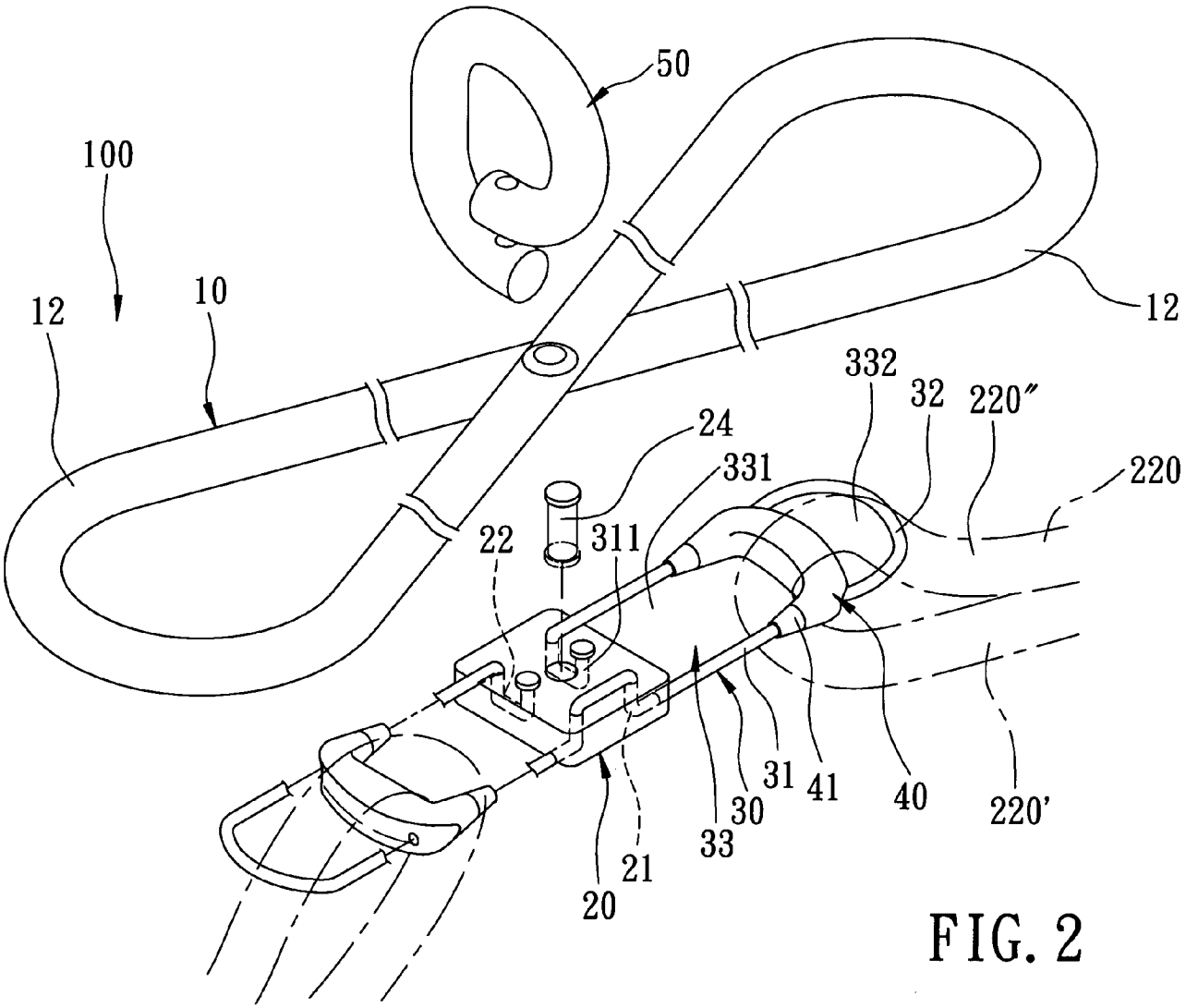
FIG. 2 is an exploded perspective view of the first preferred embodiment of a shoelace fastener according to this invention.
Figure 3:
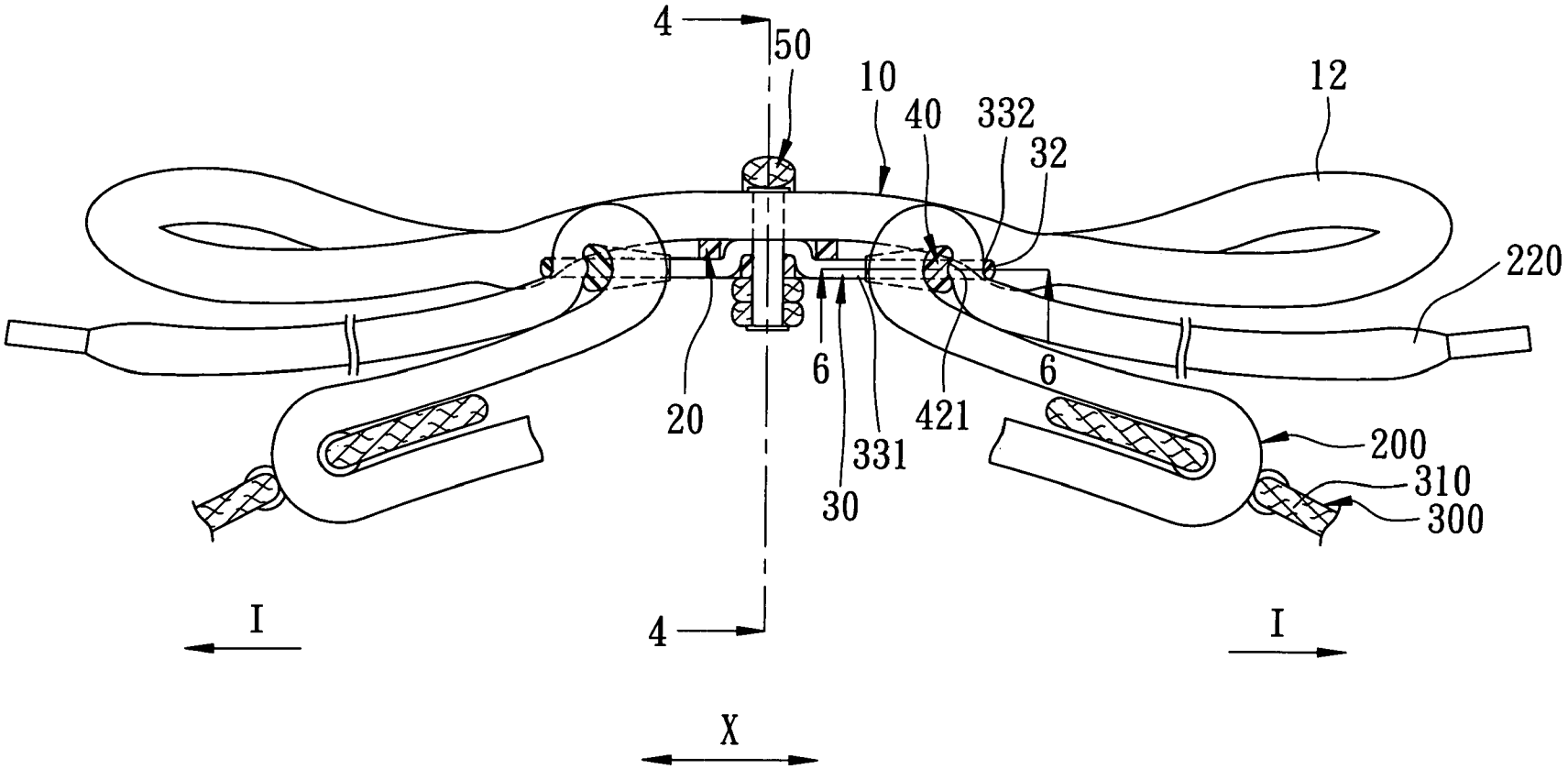
FIG. 3 is a schematic assembled sectional view of the first preferred embodiment to illustrate a tightening operation of a shoe that incorporates the first preferred embodiment.
Figure 5:
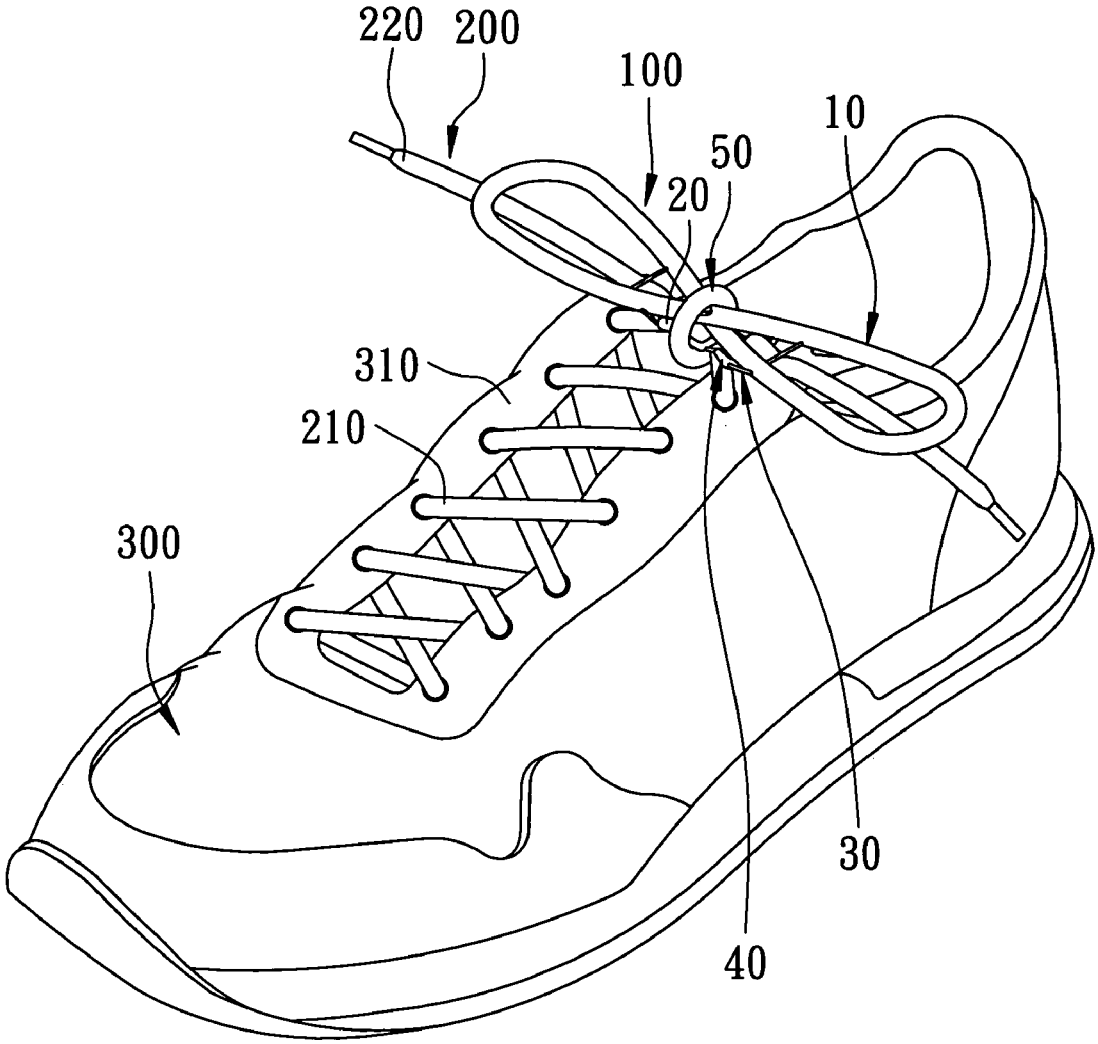
FIG. 5 is a perspective view showing a shoe that incorporates the first preferred embodiment of this invention.

Referring to FIGS. 2, 3 and 5, the first preferred embodiment of a shoelace fastener 100 according to this invention is shown to be adapted for use with a shoe which includes a shoe body 300 with a pair of eyelet tabs 310, and a shoelace 200 having an anchoring segment 210 strung on the eyelet tabs 310, and a pair of distal lace segments 220, each of which is connected to the anchoring segment 210 at one end. The shoelace fastener 100 includes a clamp unit 30, a pull lace 10, a positioning seat 20, and a tying lace 50. It should be noted herein that, except for FIG. 5, the shoelace fastener 100 is not drawn to scale in the accompanying drawings and is actually illustrated in a magnified form for the sake of clarity.

The clamp unit 30 includes a pair of flexible string sections 31 connected to each other, and a pair of clamp members 40 respectively attached to the flexible string sections 31. The flexible string sections 31 are formed from a single nylon string. Each of the flexible string sections 31 is formed in a U-shaped configuration so as to define an opening 33. Each of the clamp members 40 is attached slidably to and extends across a corresponding one of the flexible string sections 31 to divide the opening 33 into a first aperture 331 and a second aperture 332. Each of the clamp members 40 has two opposite ends 41 respectively formed with slots. The flexible string sections 31 extend through the slots. Each of the flexible string sections 31 has a U-bend 32 which cooperates with the corresponding one of the clamp members 40 to confine the second aperture 332. Each of the distal lace segments 220 has an entry part 220' and an exit part 220" connected to the entry part 220' at one end. The first aperture 331 is adapted to receive the entry part 220' of a corresponding one of the distal lace segments 220 of the shoelace 200. The second aperture 332 is adapted to receive the exit part 220" of the corresponding one of the distal lace segments 220 of the shoelace 200. Each of the clamp members 40 is slidable along the corresponding one of the flexible string sections 31 between a clamping position in which the corresponding one of the clamp members 40 moves toward the U-bend 32, and a releasing position in which the corresponding one of the clamp members 40 moves away from the U-bend 32. Each of the clamp members 40 presses the exit part 220" of the corresponding one of the distal lace segments 220 of the shoelace 200 against the U-bend 32 of the corresponding one of the flexible string sections 31 when the clamp member 40 is in the clamping position.

The pull lace 10 is connected to the flexible string sections 31 for pulling the flexible string sections 31 so that the clamp members 40 respectively slide along the flexible string sections 31 to the releasing position. The pull lace 10 is made of the same material as that of the shoelace 200, and includes a pair of interconnected loops 12. The U-bend 32 of the corresponding one of the flexible string sections 31 is attached to a corresponding one of the loops 12 of the pull lace 10.

Figure 4:
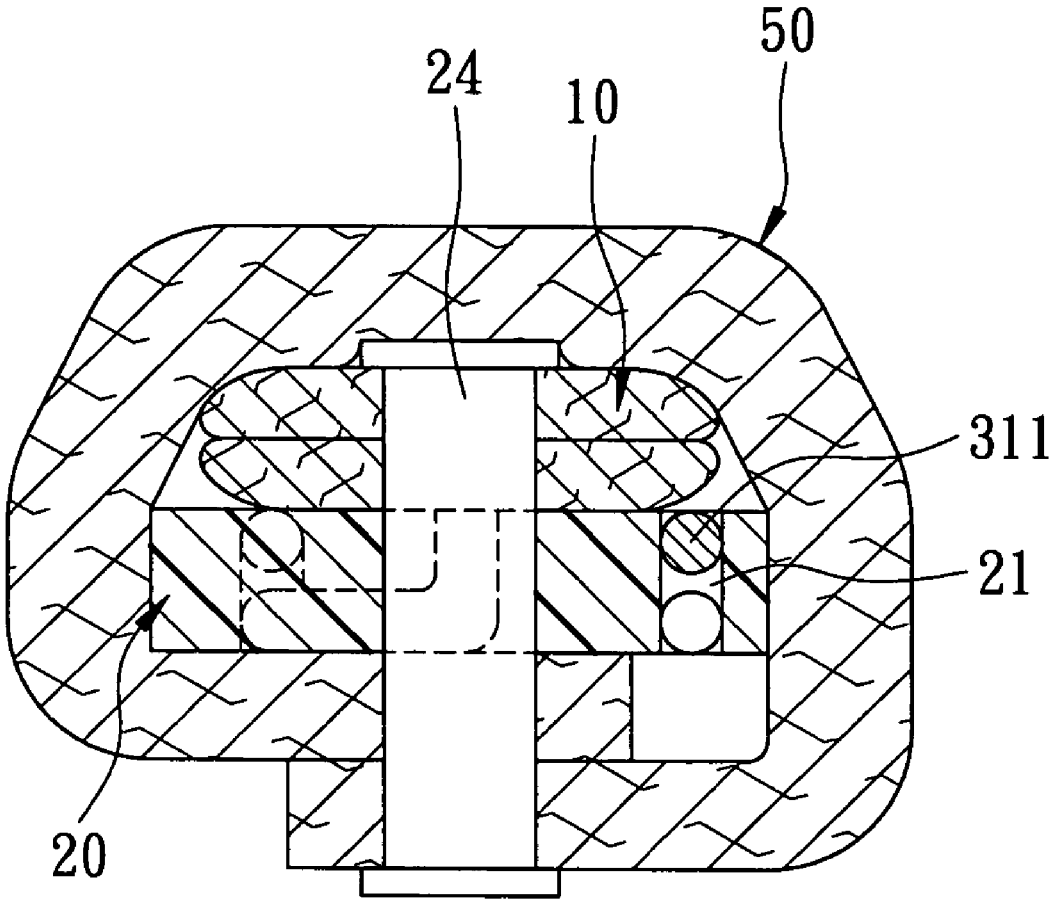
FIG. 4 is a sectional view of the first preferred embodiment, taken along line 4—4 in FIG. 3.

The positioning seat 20 is formed as a rectangular plate, and is attached to the pull lace 10 between the loops 12. Each of the flexible string sections 31 is connected to the positioning seat 20 and extends beneath a corresponding one of the loops 12. The positioning seat 20 is fastened to the pull lace 10 with the use of a rivet 24 (best shown in FIG. 4). The positioning seat 20 includes two anchoring holes 22 and a string passage 21. The single string formed into the flexbile string sections 31 passes through the string passage 21 and is bent to form the U-shaped flexible string sections 31 on two sides of the positioning seat 20. The single string has two anchoring end portions 311, which are respectively anchored to the anchoring holes 22. The tying lace 50 is made of the same material as that of the shoelace 200, and is fixed to and extends around the positioning seat 20 by riveting.

Figure 6:
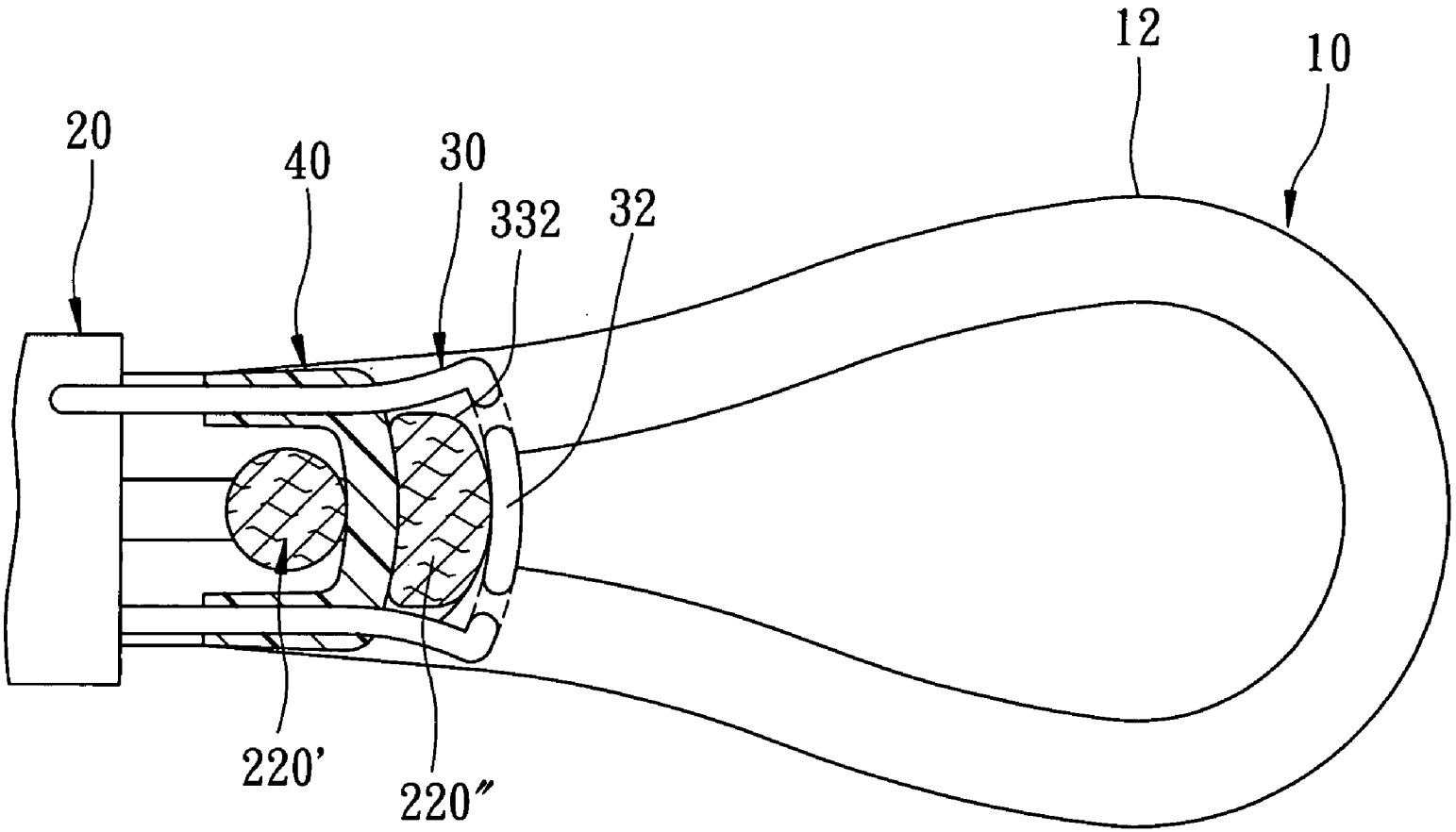
FIG. 6 is a fragmentary sectional view of the first preferred embodiment, taken along line 6—6 in FIG. 3.

Referring again to FIGS. 3 and 5, in use, each of the distal lace segments 220 is extended through the first aperture 331 of the opening 33, over the corresponding one of the clamp members 40, into the second aperture 332 of the opening 33, and out of the U-bend 32 of the corresponding one of the flexible string sections 31. At the same time, the pull lace 10, the tying lace 50 and the distal lace segments 220 cooperate to form a double-bow configuration. After a foot (not shown) is slipped into the shoe body 300, the distal lace segments 220 can be pulled apart from each other as indicated by arrows (I) in FIG. 3 to tighten the shoe body 300. When the shoe body 300 is tightened, the eyelet tabs 310 are forced apart by the foot in the shoe body 300, thereby applying tension on the shoelace 200. At the same time, each of the clamp members 40 is forced by a corresponding one of the distal lace segments 220 to move toward the U-bend 32 of the corresponding one of the flexbile string sections 31 such that each of the distal lace segments 220 is clamped in the clamping position between the corresponding one of the clamp members 40 and the corresponding U-bend 32 for maintaining a tightened state of the shoe (best shown in FIG. 6).

Figure 7:
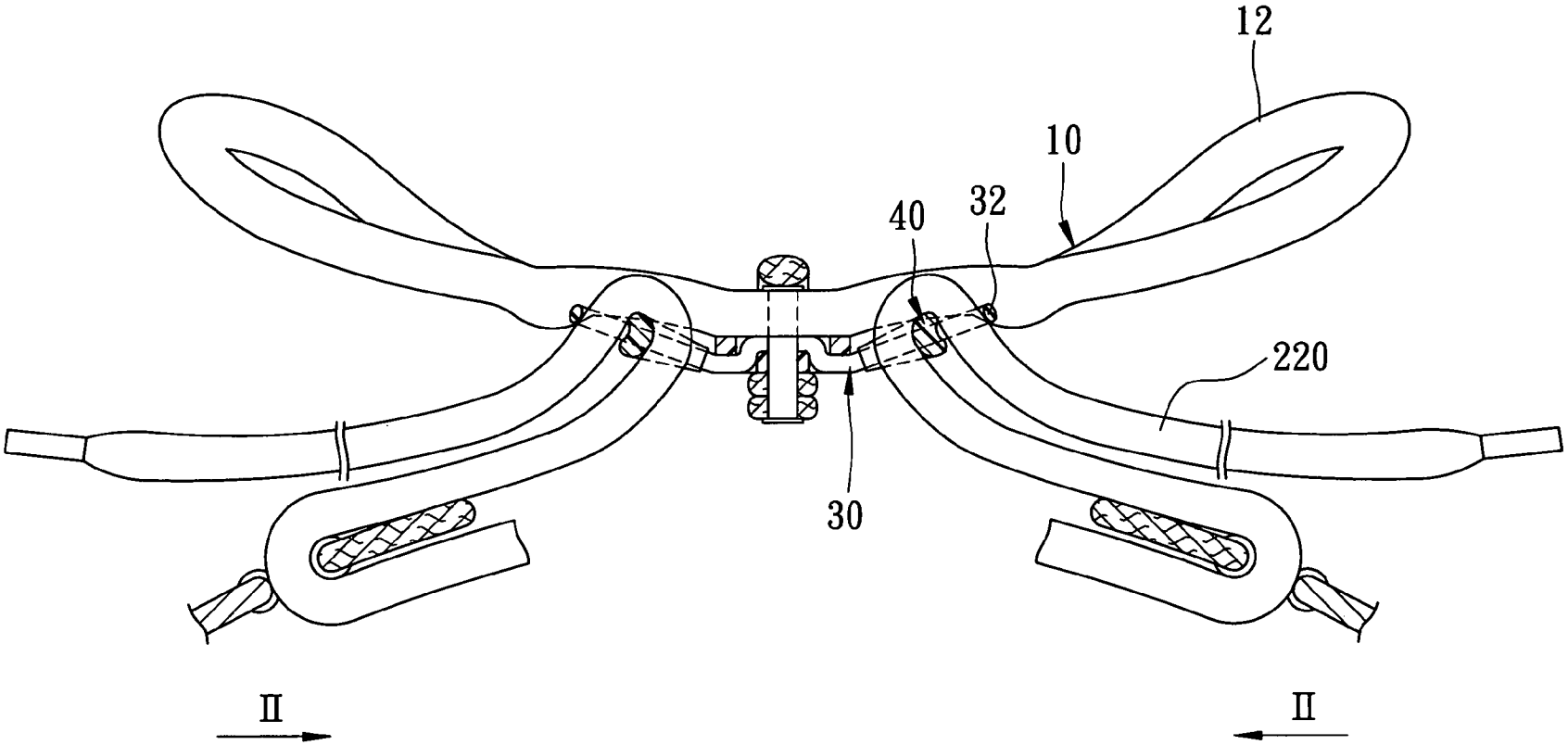
FIG. 7 is a view similar to FIG. 3, illustrating a loosening operation of the shoe.

Referring to FIG. 7, to loosen the shoe body 300, a manual pulling force is applied on the flexible string sections 31 through the pull lace 10. This results in movement of each of the clamp members 40 away from the corresponding U-bend 32, thereby releasing the distal lace segments 220 from being clamped by the clamp members 40 against the U-bends 32 so as to permit sliding movement of the distal lace segments 220 as indicated by arrows (II) in FIG. 7 for loosening the shoe body 300 accordingly.

Figure 8:
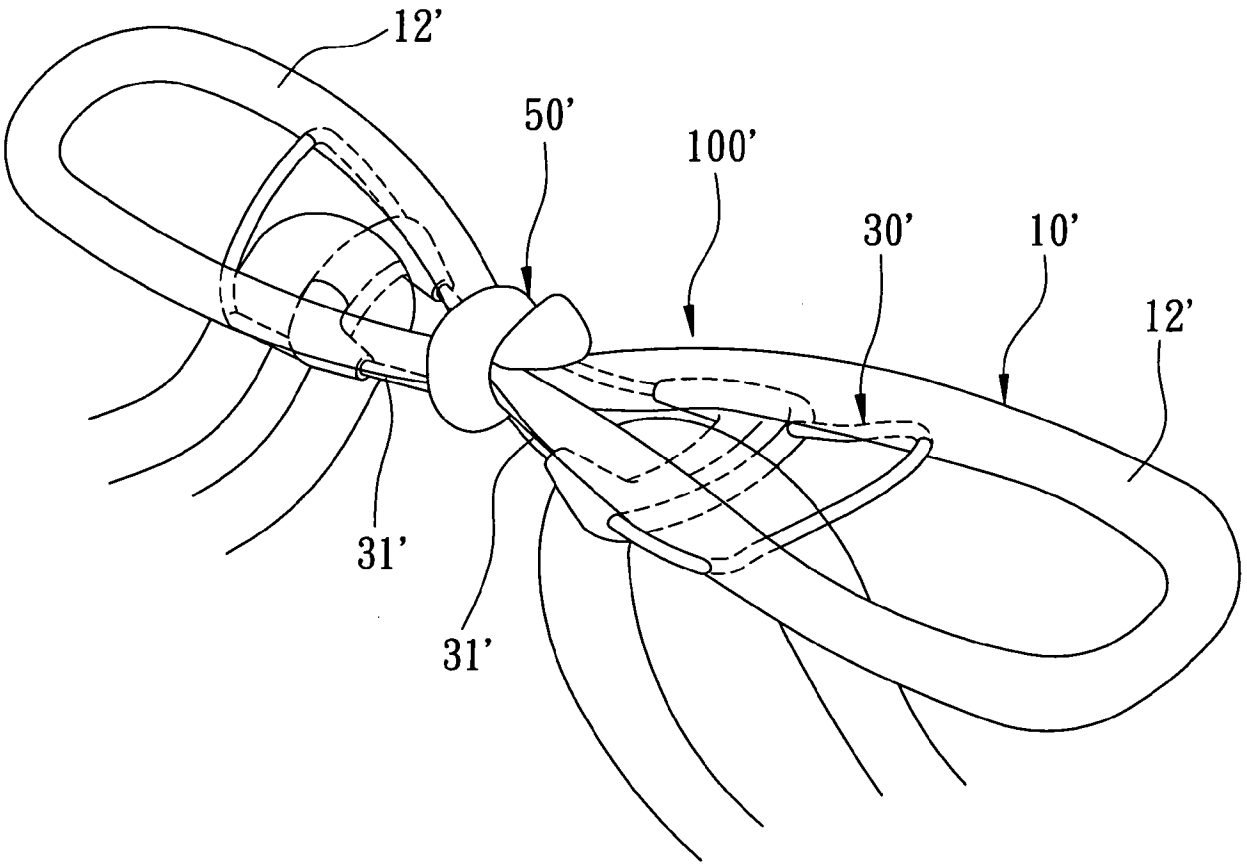
FIG. 8 is a perspective view of the second preferred embodiment of a shoelace fastener according to this invention.

Referring to FIG. 8, the second preferred embodiment of the shoelace fastener 100' according to this invention is shown to be similar to the first preferred embodiment, except that the shoelace fastener 100' does not include the positioning seat 20, and that the tying lace 50' extends around the pull lace 10' and the clamp unit 30'. The loops 12' are interconnected, and the flexible string sections 31' are interconnected. Both of the pull lace 10' and the clamp unit 30' are fixed directly to the tying lace 50'.

Figure 9:
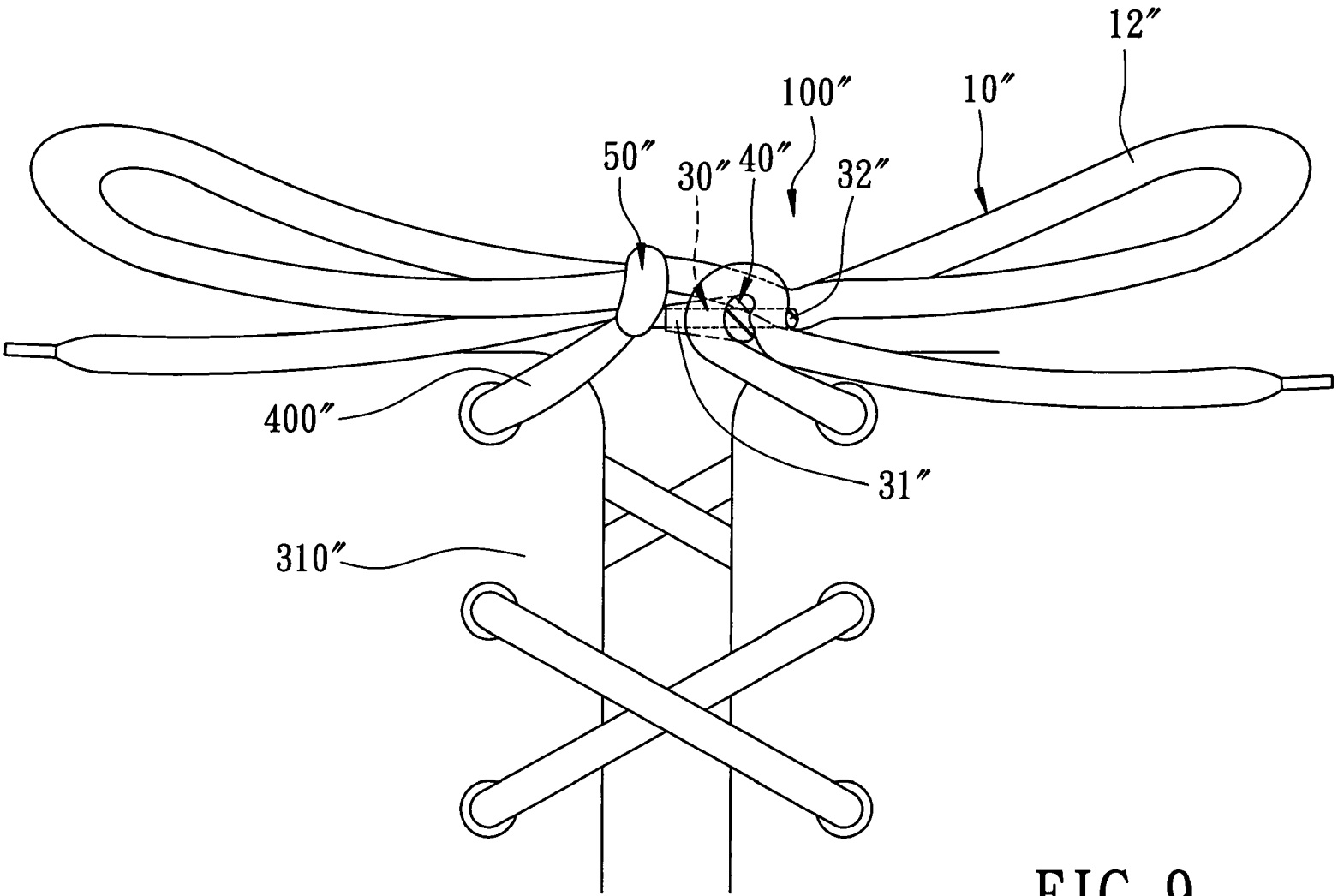
FIG. 9 is a schematic partly sectional assembled view of the third preferred embodiment of a shoelace fastener according to this invention, which illustrates a tightening operation of a shoe that incorporates the third preferred embodiment.
Figure 10:
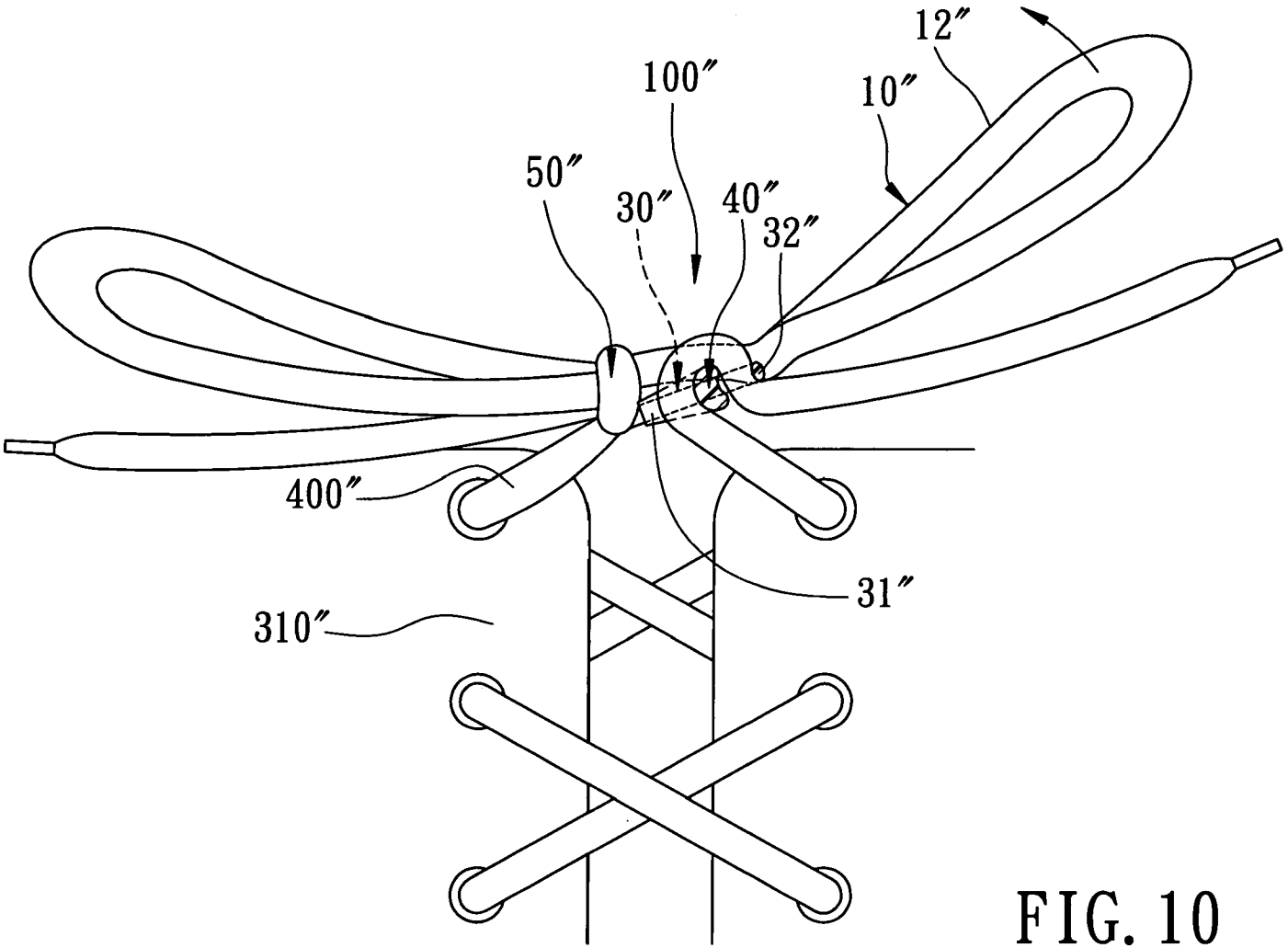
FIG. 10 is a view similar to FIG. 9, illustrating a loosening operation of the shoe.
Figure 11:
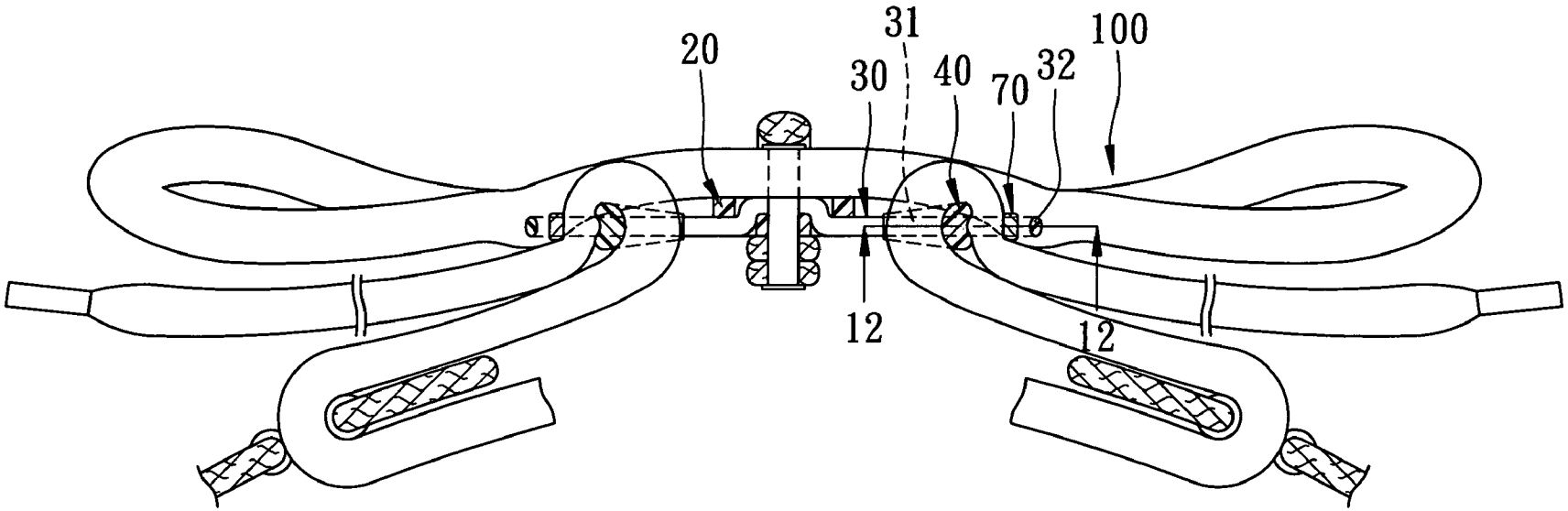
FIG. 11 is a schematic assembled sectional view of the fourth preferred embodiment of a shoelace fastener according to this invention.
Figure 12:
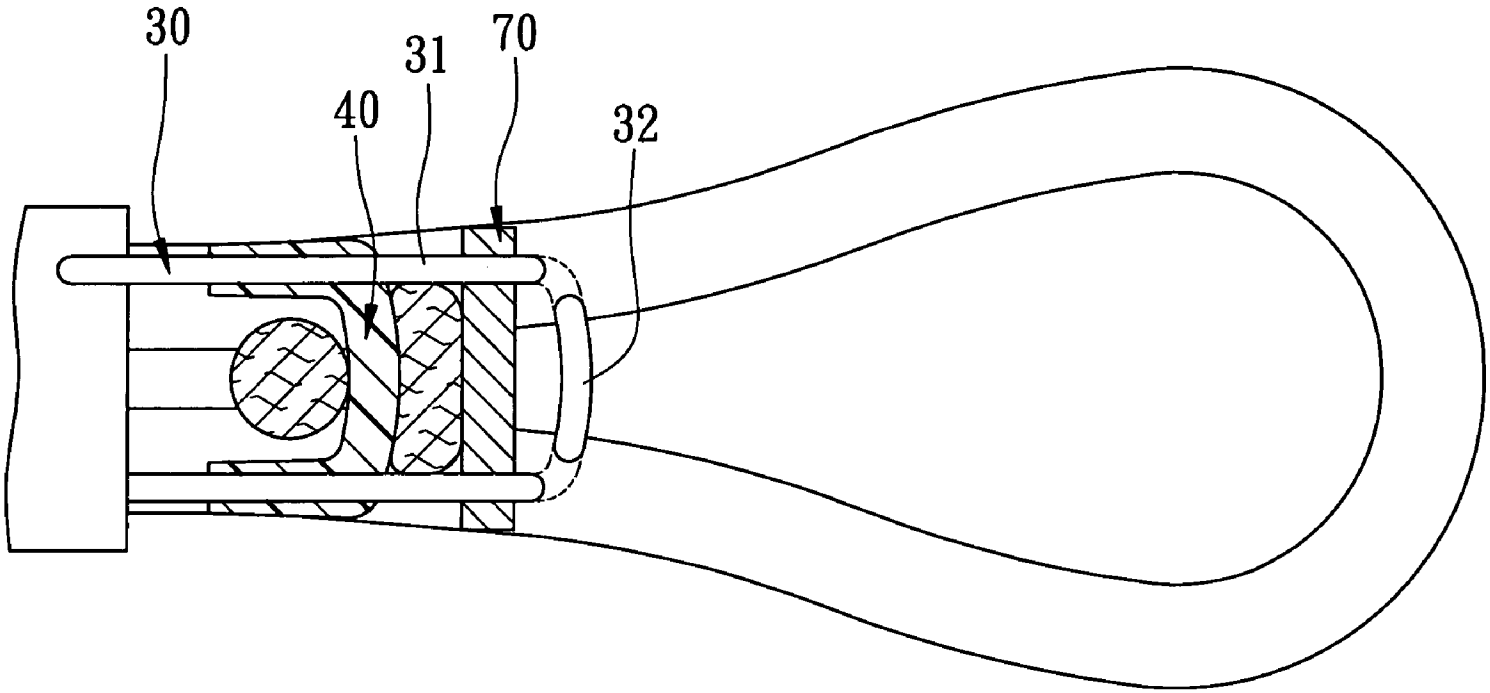
FIG. 12 is a sectional view of the fourth preferred embodiment, taken along line 12—12 in FIG. 11.

Referring to FIGS. 9 and 10, the third preferred embodiment of the shoelace fastener 100" according to this invention is shown to be similar to the first preferred embodiment, except that the clamp unit 30" is configured as a single U-shaped flexible string section 31" and a single clamp member 40", and that the pull lace 10" is configured as a single loop 12", which is connected to the flexible string section 31" of the clamp unit 30" at the U-bend 32". Both of the pull lace 10" and the clamp unit 30" are fixed directly to the tying lace 50". Furthermore, one of the distal lace segments 400" is fixed directly to the tying lace 50", and is anchored to a corresponding one of the eyelet tabs 310" at one end. Referring to FIGS. 11 and 12, the fourth preferred embodiment of the shoelace fastener 100 according to this invention is shown to be similar to the first preferred embodiment, except that the clamp unit 30 further includes blocking units 70, each of which is attached to and extends across the corresponding one of the flexible string sections 31, and each of which is disposed between the corresponding one of the clamp members 40 and the corresponding one of the U-bends 32.

Figure 13:
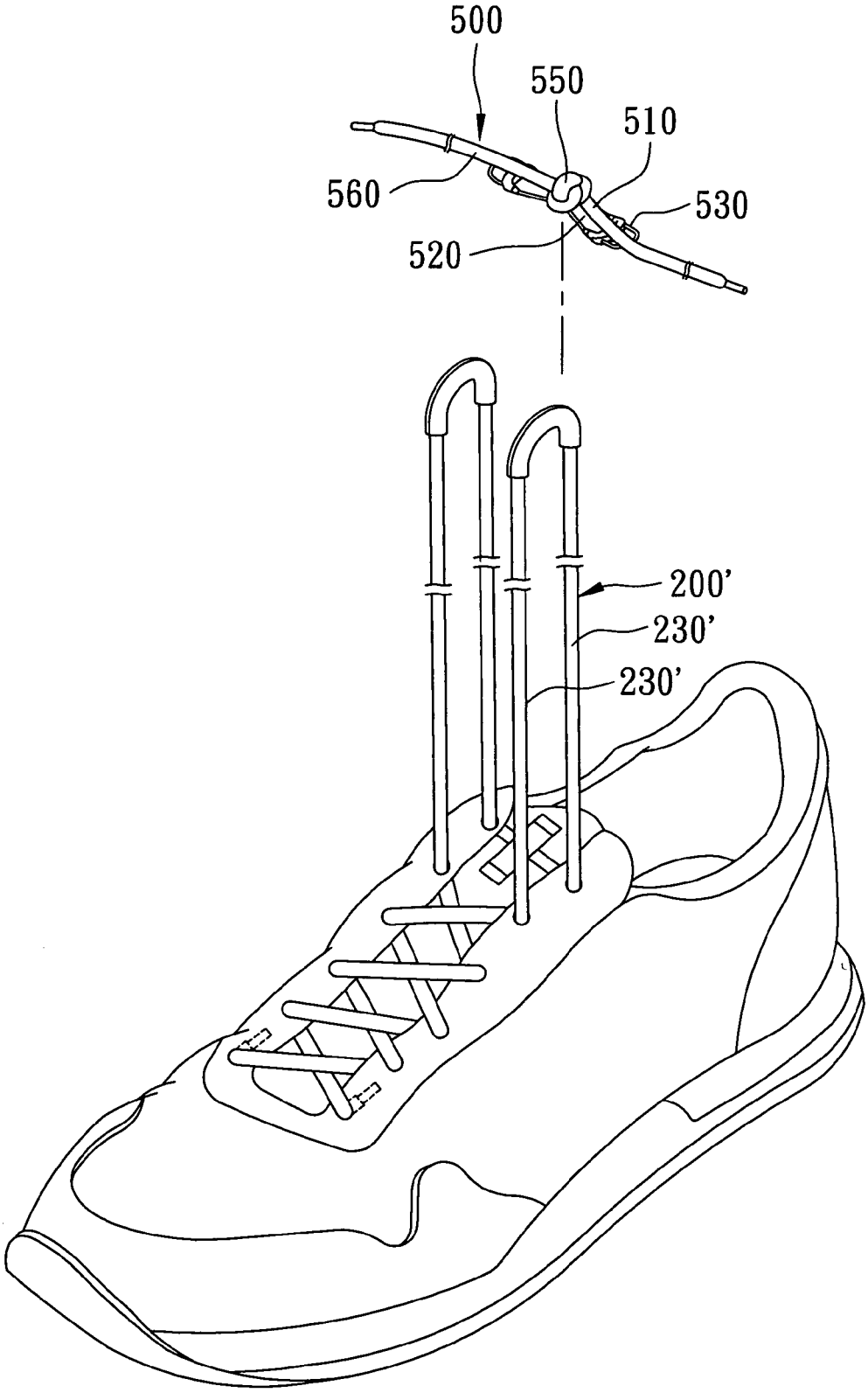
FIG. 13 is a perspective view of the fifth preferred embodiment of a shoelace fastener according to this invention, which is adapted to be applied to a shoe.
Figure 14:
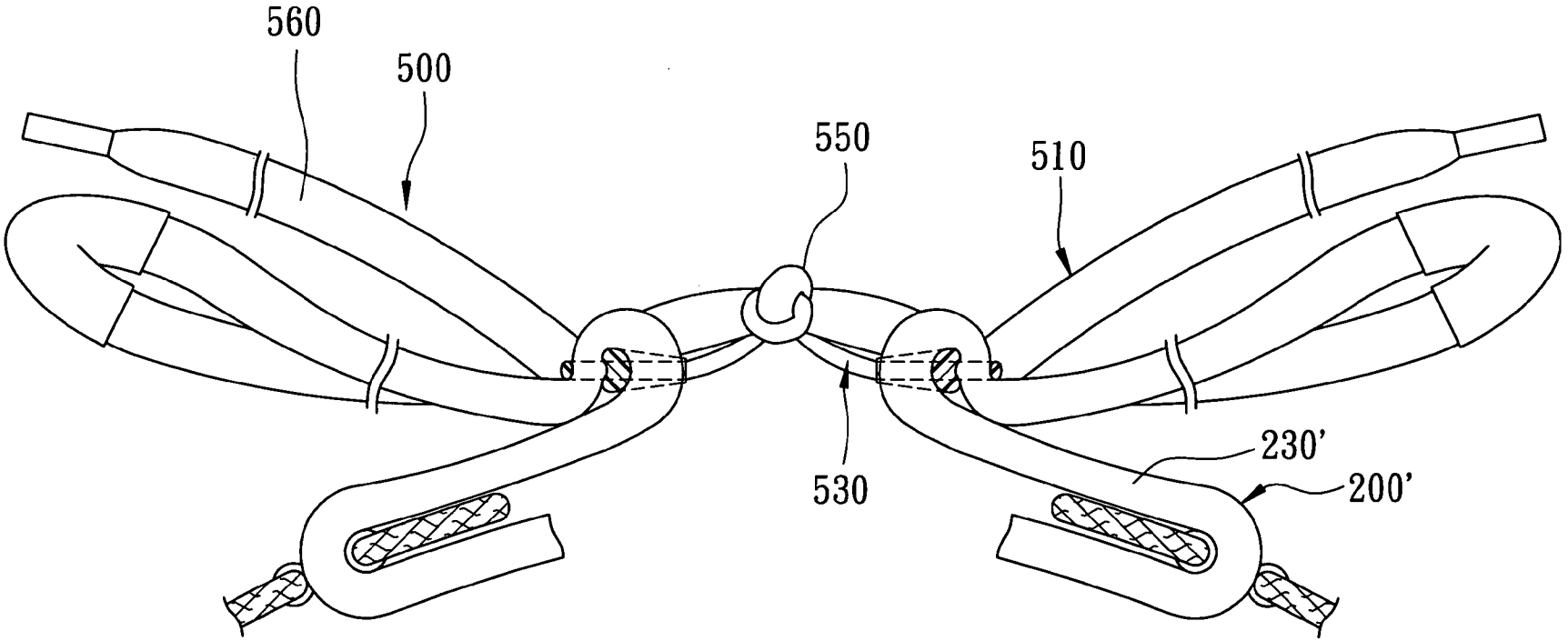
FIG. 14 is a schematic assembled sectional view of the fifth preferred embodiment.

Referring to FIGS. 13 and 14, the fifth preferred embodiment of the shoelace fastener 500 according to this invention is shown to be similar to the second preferred embodiment, except that a tying knot 550 is connected to the flexible string sections 530 between the openings 520 of the flexible string sections 530. The pull lace 510 has two string segments 560 extending outward from the knot 550. Each of the string segments 560 is a single-line string segment. Each of the distal lace segments 230' of the shoelace 200' is formed in a U-shaped configuration so that the pull lace 510, the tying knot 550 and the distal lace segments 230' cooperate to form a double-bow configuration.

In view of the aforesaid, the shoelace fastener 100,100', 100",500 of the present invention is easy to operate. Moreover, since there is no need to hold the shoelace fastener 100,100',100",500 when it is desired to loosen a shoe, the size of the shoelace fastener 100,100',100",500 can be designed to be smaller as compared to the prior art so as not to result in an adverse affect on the appearance of the shoe.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A shoelace fastener for a shoe, the shoe including a shoe body with a pair of eyelet tabs, and a shoelace strung on the eyelet tabs and having a pair of distal lace segments, said shoelace fastener comprising:

a clamp unit including at least one generally U-shaped flexible string section defining an opening, and at least one clamp member attached slidably to and extending across said flexible string section to divide said opening into a first aperture and a second aperture, said flexible string section having a U-bend which cooperates with said clamp member to confine said second aperture, said clamp member being slidable along said flexible string section between a clamping position in which said clamp member moves toward said U-bend to clamp a corresponding one of the distal lace segments against said U-bend for maintaining a tightened state of the shoe, and a releasing position in which said clamp member moves away from said U-bend to permit sliding movement of the corresponding one of the distal lace segments for loosening the shoe accordingly; and a pull lace connected to said flexible string section for pulling said flexible string section so that said clamp member slides along said flexible string section to said releasing position.

2. The shoelace fastener as claimed in claim 1, wherein said first aperture is adapted to receive an entry part of the corresponding one of the distal lace segments of the shoelace, said second aperture being adapted to receive an exit part of the corresponding one of the distal lace segments of the shoelace, said clamp member pressing the exit part of the corresponding one of the distal lace segments of the shoelace against said U-bend of said flexible string section when said clamp member is in said clamping position, said U-bend being attached to said pull lace.

3. The shoelace fastener as claimed in claim 1, wherein said clamp member has two opposite ends respectively formed with slots, said flexible string section extending through said slots.

4. The shoelace fastener as claimed in claim 1, wherein said clamp unit includes a pair of said flexible string sections connected to each other, and a pair of said clamp members respectively attached to said flexible string sections.

5. The shoelace fastener as claimed in claim 4, wherein said pull lace includes a pair of interconnected loops.

6. The shoelace fastener as claimed in claim 5, further comprising a positioning seat attached to said pull lace between said loops, each of said flexible string sections being connected to said positioning seat and extending beneath a corresponding one of said loops, each of said flexible string sections having said U-bend attached to a corresponding one of said loops.

7. The shoelace fastener as claimed in claim 6, wherein said positioning seat is riveted to said pull lace.

8. The shoelace fastener as claimed claim 6, wherein said positioning seat includes two anchoring holes and a string passage, said flexible string sections being formed from a single string which passes through said string passage and which is bent to form said U-shaped flexible string sections on two sides of said positioning seat, said single string having two anchoring end portions, which are respectively anchored to said anchoring holes.

9. The shoelace fastener as claimed in claim 6, further comprising a tying lace fixed to and extending around said positioning seat.

10. The shoelace fastener as claimed in claim 5, further comprising a tying lace which extends around said pull lace and said clamp unit where said loops are interconnected and where said flexible string sections are interconnected, both of said pull lace and said clamp unit being fixed directly to said tying lace.

11. The shoelace fastener as claimed in claim 4, further comprising a tying knot connected to said flexible string sections between said openings of said flexible string sections, said pull lace having two string segments extending outward from said knot.

12. The shoelace fastener as claimed in claim 11, wherein each of said string segments is a single-line string segment.

13. The shoelace fastener as claimed in claim 1, wherein said pull lace includes a loop connected to said flexible string section of said clamp unit at said U-bend.

14. The shoelace fastener as claimed in claim 1, wherein said clamp unit further includes a blocking unit which is attached to and which extends across said flexible string section, and which is disposed between said clamp member and said U-bend.

* * * * *